United States Patent [19]

Guth et al.

[11] Patent Number: 4,658,957

[45] Date of Patent: Apr. 21, 1987

[54] UTILITY TRAY

[75] Inventors: Gordon T. Guth, Evanston; James D. Morrow, Oak Park; Lois R. Sherry, Northfield, all of Ill.

[73] Assignee: Abbott Laboratories, North Chicago, Ill.

[21] Appl. No.: 859,968

[22] Filed: May 5, 1986

Related U.S. Application Data

[63] Continuation of Ser. No. 695,314, Jan. 28, 1985, abandoned.

[51] Int. Cl.[4] ..... B65D 83/10

[52] U.S. Cl. ..... 206/365; 206/366; 206/563; 206/459

[58] Field of Search ..... 206/365, 366, 367, 368, 206/369, 364, 563, 562, 459

[56] References Cited

U.S. PATENT DOCUMENTS

| | | | |
|---|---|---|---|
| 2,826,347 | 3/1958 | Schiavo | 206/563 |
| 3,013,656 | 12/1961 | Murphy, Jr. | 206/563 |
| 4,039,080 | 8/1977 | Cappuccilli | 206/459 |
| 4,195,734 | 4/1980 | Boner et al. | 206/562 |
| 4,295,567 | 10/1981 | Knudsen | 206/459 |
| 4,349,338 | 9/1982 | Hepzer | 206/459 |
| 4,473,156 | 9/1984 | Martin | 206/459 |

*Primary Examiner*—Joseph Man-Fu Moy

*Attorney, Agent, or Firm*—Steven F. Weinstock; Martin L. Katz

[57] ABSTRACT

An utility tray includes a plurality of holders sized to accommodate a removable sleeve or cap of a hypodermic syringe, once the syringe is to be prepared for administration of medication. Each holder is arranged relative to indicia to remind an user of the number of doses of medication administered. The tray also includes a waste disposal depository, a syringe rest and various storage compartments.

4 Claims, 8 Drawing Figures

UTILITY TRAY

This is a continuation of application Ser. No. 695,314 filed Jan. 28, 1985 now abandoned.

TECHNICAL FIELD

The invention relates to an utility tray and, more particularly, to a pharmaceutical utility tray for administration of medication and monitoring thereof.

BACKGROUND ART

A variety of pharmaceutical packages or kits well known in the art provide holders for syringes and/or a vial(s) of medication for administration by patients at their convenience, typically at home at predetermined times with predetermined amounts of medication. For example, U.S. Pat. No. 4,318,473 issued Mar. 9, 1982, discloses a dispensing package which arranges pharmaceutical medication in rows and columns to indicate to the user when the predetermined daily dosage of medication is to be taken.

Another such pharmaceutical kit disclosed in U.S. Pat. No. 4,349,338 issued Sept. 14, 1982, provides for the maintaining of syringes in an upper end of housing, the syringes being arranged with indicia to indicate the day of use. The presence or absence of the syringe from its proper holder indicates whether the dosage has been taken. Similarly, see U.S. Pat. No. 4,383,615 issued May 17, 1983.

Although a dosage tracking system is desirable in a pharmaceutical package, the above-mentioned tracking system necessitates the user to select the proper, and not just any, syringe for the appropriate indicia, e.g. day, week, time, location of administration, etc. Further, while these packages may be satisfactory for some applications, other applications may not lend themselves to storage in predetermined compartments because of sterility, for example.

In addition to the above-noted concerns, it is preferable to design a kit or package to store a supply of syringes, alcohol wipes, and/or vials of the medication in a pharmaceutical package for easy dispensing. Further, the packaging should be designed to facilitate removal of pharmaceutical items and preparation of materials to administer medication, since oftentimes patients have difficulty in manipulating small items from the packaging. In the same regard, packaging should preferably facilitate proper administration of medication by proper aseptic technique and easy and safe disposal of items utilized in administrating medication.

DISCLOSURE OF THE INVENTION

In accordance with the invention, an utility tray includes a plurality of holders each capable of receiving a removable sleeve or cap of a hypodermic syringe used to administer medication to an user. The plurality of holders in conjunction with indicia arranged proximate thereto provide means for reminding the user of the amount, time, number of doses, etc., of medication administered by the user. Additionally, the utility tray includes a plurality of compartments to store a plurality of syringes, alcohol wipes and/or vials of medication, etc., for easy dispensing. To facilitate preparation of materials, e.g. filling a syringe with medication and holding it aseptic while the user is preparing administration of the same, a syringe rest is provided. Further, a waste disposal depository is provided to facilitate proper and safe disposal of the wipes and syringe, etc., subsequent to the administration of medication.

BRIEF DESCRIPTION OF THE DRAWINGS

The invention will now be described with reference to the accompanying drawings in which.

BEST MODE FOR CARRYING OUT THE INVENTION

Figure 1:
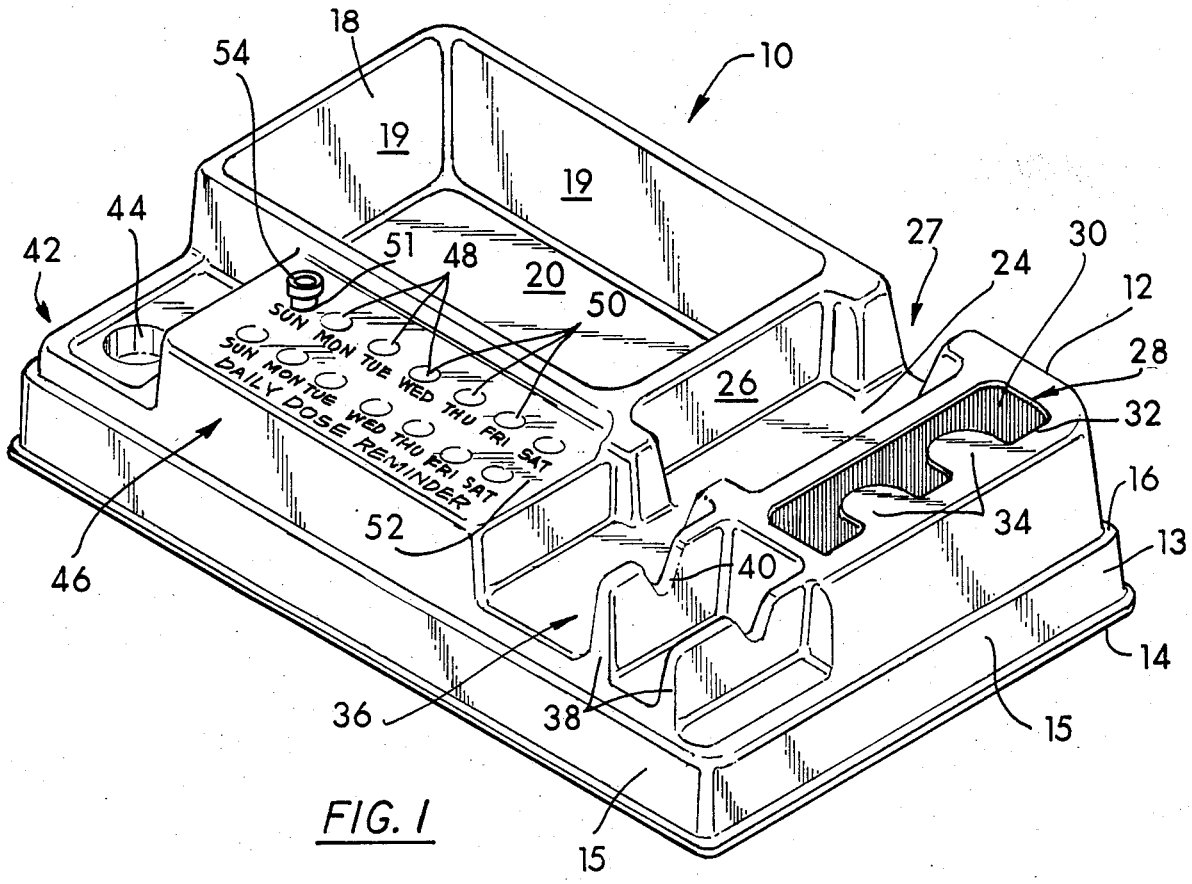
FIG. 1 is a front perspective view of a utility tray in accordance with the invention.
Figure 2:
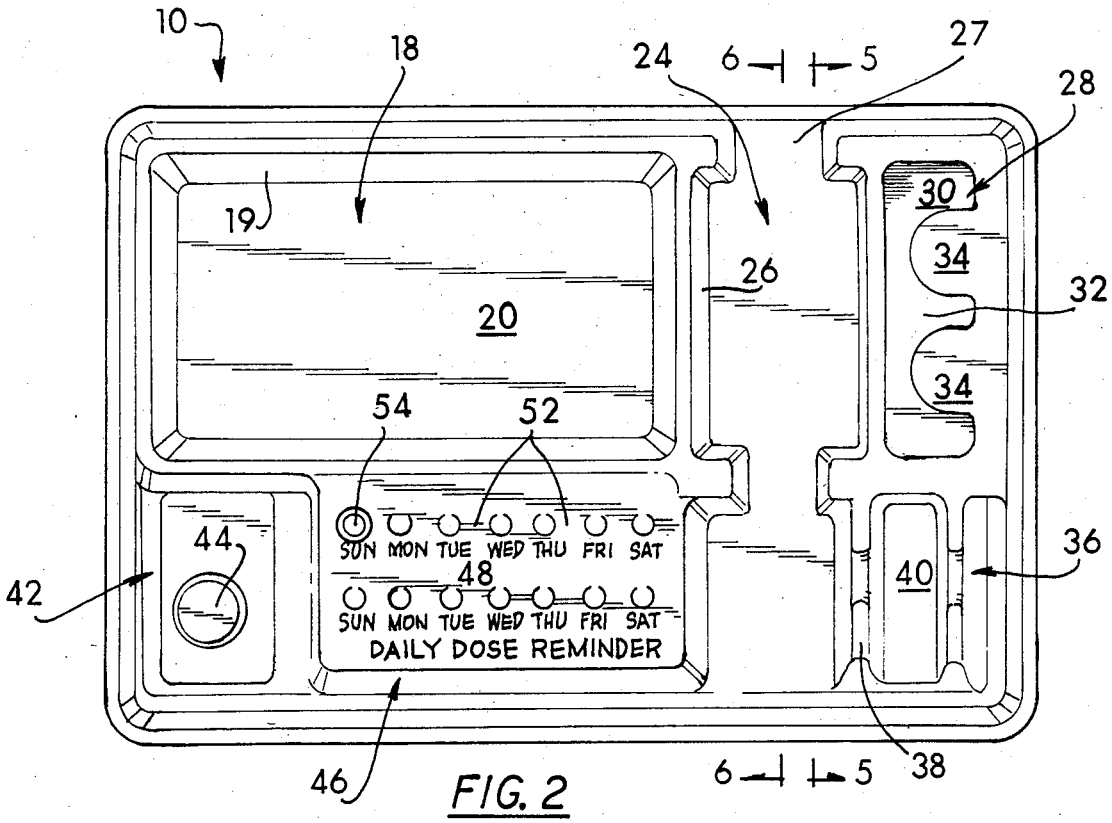
FIG. 2 is a top plan view of the tray of FIG. 1.
Figure 3:
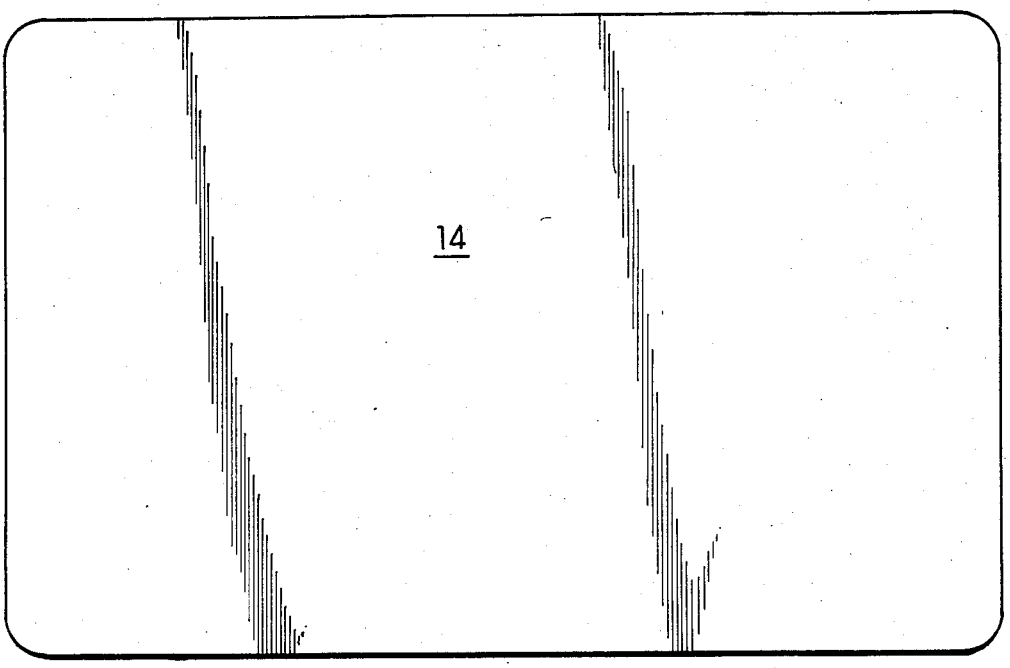
FIG. 3 is a bottom plan view of the tray of FIG. 1.
Figure 5:
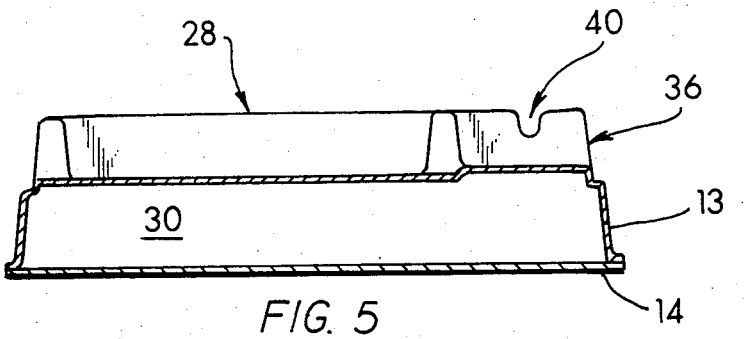
FIG. 5 is a side, cross-sectional view of the tray of FIG. 2 taken along lines 5—5.
Figure 4:
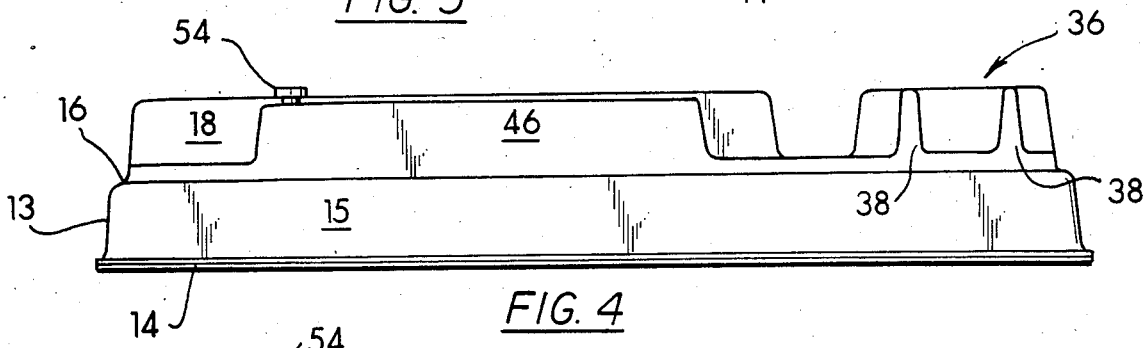
FIG. 4 is a front of the tray of FIG. 1.

In accordance with the invention, an utility tray 10, as best seen in FIG. 1, is designed as a compact unit for shipping and supporting items necessary for the administration of a medication. The tray 10 is comprised of a top section 12, a middle, reservoir enclosing section 13 and a bottom plate 14. The top section 12 and middle section 13 are typically molded into one piece, while the bottom plate 14 is adhered to the bottom of the middle section 13 by conventional means. The middle section 13 includes a plurality of walls 15 which extend vertically between the top section 12 and bottom plate 14. These walls 15 also form a lip 16 to retain a cover (not shown) over the top section 12 when the tray 10 is shipped or stored away.

The top section 12 of the tray 10 has a plurality of storage compartments 18, 24 and 42 for holding contents such as sterile prepackaged, disposable hypodermic syringes (not shown) each having a removable sleeve or cap which covers the needle portion of the syringe, a plurality of prepackaged alcohol wipes (not shown) for the preparation of the vial and the injection site and a vial (not shown) containing the medication to be administered. The top section 12 also includes a waste disposal depository 28, a syringe rest 36 and a syringe needle cap holding section 46 which serves as means for reminding an user of the daily dose of medication administered.

A first storage compartment 18 includes four walls 19 and a bottom 20 into which hypodermic syringes are typically stored. Adjacent to the first storage compartment 18, is a second storage compartment 24 which is likewise formed by a plurality of walls 26, some of which do not run continuously into each other so as to provide at least one access 27 enabling an user to take out of the compartment 24 whatever is stored therein, e.g. wipes. The third storage compartment 42 having a vial recess 44 sized to firmly hold a vial of medication, is provided adjacent the compartment 18 and section 46.

Adjacent the second storage compartment 24 is a waste disposal depository 28 including a slot 32 into which waste materials can be inserted and a reservoir 30 in which the waste materials are deposited and stored. The reservoir 30 is formed by the walls 15 of the middle section 13 and the interior side of both the top section 12 and the bottom plate 14, and may be contiguous and integral with a chamber 53, described hereinbelow, located beneath the needle cap holding section 46. The reservoir 34 is sized to accommodate the disposal of the prepackaged and/or contaminated hypodermic syringes or the prepackaged alcohol wipes. The slot 32 is, in part, formed by at least one flexible flap 34 which protrudes into the slot 32 to prevent the exiting of the contaminated syringes once they have been inserted through the slot 32 and into the disposal reservoir 30.

Adjacent to the depository 28 is a syringe rest 36 which is formed by a plurality of gussets 38. The gussets 38 each have an indent 40 which provides location into which a syringe may be set. When a syringe is properly set into the indents 40 with the needle of the syringe pointed toward the syringe needle cap holding section 46, the user is protected from accidently contacting the needle whereas the section 46 is elevated above and immediately adjacent the indents 40.

Figure 6:
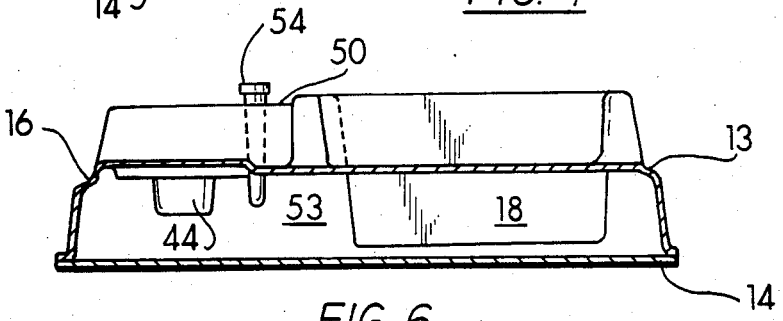
FIG. 6 is a side, cross-sectional view of the tray of FIG. 2 taken along lines 6—6.
Figure 7:
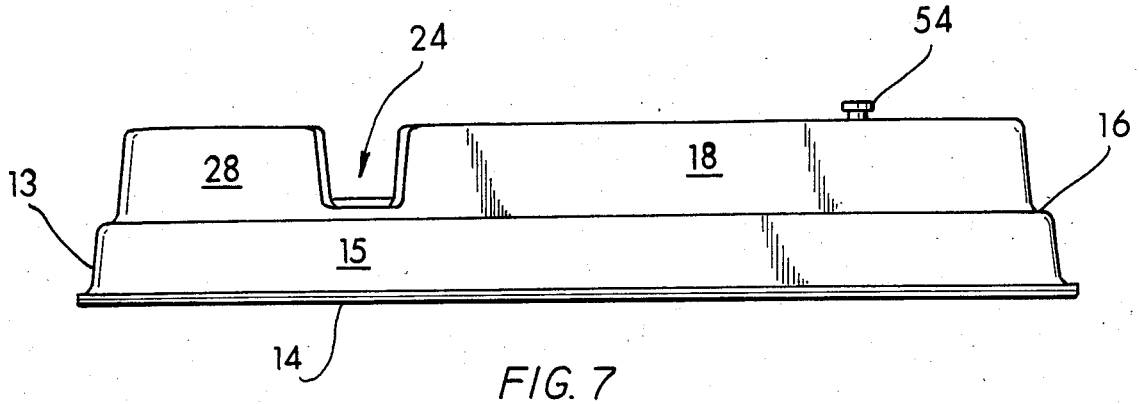
FIG. 7 is a rear side view of the tray depicted in FIG. 1.
Figure 8:
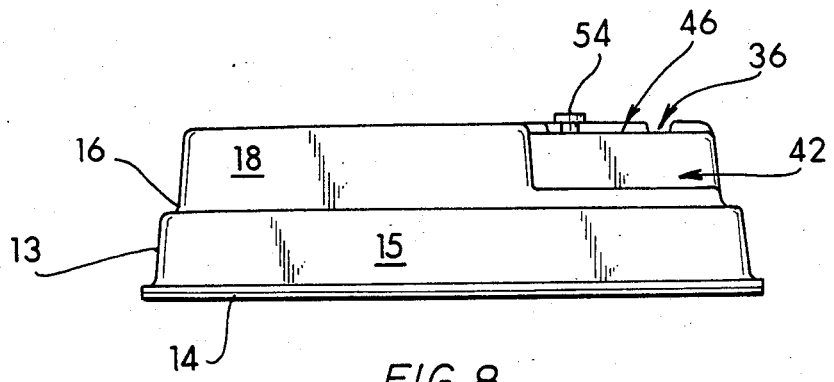
FIG. 8 is a view of the side not shown in the tray depicted in FIG. 1.

The syringe needle cap holding section 46, adjacent to the compartment 18 and the syringe rest 36, is comprised of a plurality of needle cap holders 48 for holding a sleeve portion 54 of a hypodermic syringe. Each holder includes a flexible flap 50 which is inwardly bendable when a syringe cap 54 is pushed thereagainst and which covers a hole or access 51 to a chamber 53 (FIG. 6) into which a cap 54 can protrude. The hole 51 is sized to hold the upper collar of the cap 54, yet provide access to the chamber 53 for the protruding portion of the cap 54. A plurality of indicia 52 are adhered proximate to the holders 48 and can indicate time, date, number of doses, etc. When the cap 54 is placed in a sleeve holder 48 prior to administration of the medication, an user will be able to keep track or later be reminded of the date, time or number of doses of medication administered.

Use of the preferred embodiment of the invention is initiated when an user removes a syringe stored in the storage compartment 18. A sterile covering (not shown) is removed from the syringe and the rubber stopper of the vial, set in the recess 44, is dampened with an alcohol wipe stored in the storage compartment 24. The syringe sleeve 54 of the syringe is removed therefrom and placed into the appropriate sleeve holder 48, thereby indicating, for example, that that administration of medication for that day has been given. The syringe is then filled with the medication contained in the vial by either first removing the vial from the recess 44 and then inserting the syringe needle therein and withdrawing the medication from the vial, or inserting the syringe needle into the vial, firmly set in and supported by the recess 44, and then removing the vial from the recess and withdrawing the medication into the syringe. Once the medication is filled in the syringe, the syringe itself may be set on the syringe rest 36, with the needle pointed toward the cap holding section 46, thereby providing a safe location on which to set the syringe while the injection site is prepared for the administration of medication. Alcohol wipes stored in the storage compartment 24 are then utilized to dampen the injection site. The user is then ready to administer the filled syringe. Waste materials from the prepackaged syringe and from the prepackaged alcohol wipes may be disposed of through the slot 32 into the waste disposal reservoir 30.

It is therefore apparent that the present invention provides an utility tray that affords a convenient and safe workstation including storage compartments and a syringe rest, means for allowing the user to easily keep track of the user's regulated medication requirements and a readily accessible waste disposal reservoir.

The foregoing invention can now be practiced by those skilled in the art. Such skilled persons will know that the invention is not necessarily restricted to the particular embodiment presented herein. For example, although the particular embodiment is described hereinabove wherein the reminding means utilizes the sleeves of syringes, such means could analogously be used with caps to small bottles of medication to be orally ingested and stored in the compartments described hereinabove.

We claim:

1. An utility tray for storing a plurality of pharmaceutical items and for providing a convenient work station for administration of a medication by a user comprising a plurality of hypodermic needle syringes and a vial of medication, said tray comprising:

a plurality of walls, a top side and a bottom plate;

a cavity formed by the interior of said walls, side and plate;

a compartment integral with said top side for storing said syringes;

means for reminding an user of the number of doses of medication administered, said reminding means comprising a plurality of spaced-apart holders located on a top side of said utility tray, said holders comprising a plurality of round apertures formed by said top side and providing access for a removable sleeve of said syringe into said cavity and a plurality of retaining rims integral to said top side adjacent said apertures, each rim preventing a portion of said sleeve from falling into said cavity upon insertion of said sleeve into said aperture and means for indicating when said medication is to be administered by a user, said indicating means arranged relative to said spaced-apart holders; and means for the disposal of said syringe comprising means for access to said cavity from said top side and at least one flap protruding into said access means.

2. The tray according to claim 1 wherein said disposal means comprises a reservoir formed within and by the walls, top side and bottom plate, means for access to said reservoir from said top side of said container and at least one flap protruding into said access means, thereby retaining waste materials in said reservoir once inserted therein.

3. The tray according to claim 2 further comprising a compartment sized to accommodate a vial.

4. The tray according to claim 3 further comprising means for resting said syringe therein, said means integral with said top side.

* * * * *